US011319034B1

(12) United States Patent
Araki et al.

(10) Patent No.: US 11,319,034 B1
(45) Date of Patent: May 3, 2022

(54) PERSONAL WATERCRAFT

(71) Applicant: KAWASAKI JUKOGYO KABUSHIKI KAISHA, Kobe (JP)

(72) Inventors: Toshio Araki, Kakogawa (JP); Hiroaki Maeda, Kakogawa (JP); Yoshinobu Uozumi, Amagasaki (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 41 days.

(21) Appl. No.: 17/085,222

(22) Filed: Oct. 30, 2020

(51) Int. Cl.
*B63B 34/10* (2020.01)
*F02B 61/04* (2006.01)
*B63B 29/04* (2006.01)

(52) U.S. Cl.
CPC ..... *B63B 34/10* (2020.02); *F02B 61/045* (2013.01); *B63B 2029/043* (2013.01); *B63B 2201/08* (2013.01)

(58) Field of Classification Search
CPC ..... B63B 34/10; B63B 2029/043; B63B 2201/08; F02B 61/045
See application file for complete search history.

(56) References Cited

U.S. PATENT DOCUMENTS 4,694,770 A * 9/1987 Kitner ..... B63B 34/10 114/123
5,850,803 A * 12/1998 Jones ..... F02B 61/045 114/343
6,712,018 B2 * 3/2004 Cassell ..... B63B 29/02 114/364
10,457,358 B1 * 10/2019 Granata ..... B60Q 1/143

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes: a watercraft body including a hull and a deck covering an upper portion of the hull; a light emitter supported by the watercraft body; and a protection cover covering the light emitter and permeable to light emitted by the light emitter, wherein the watercraft body includes a flow-regulating structure, and the flow-regulating structure includes: a fluid inlet through which an external fluid enters the watercraft body; and an upper flow-regulating wall and a lower flow-regulating wall that are opposed to each other in an up-down direction, the upper and lower flow-regulating walls being located between the fluid inlet and the protection cover to regulate flow of the fluid entering the watercraft body through the fluid inlet and moving toward the protection cover.

13 Claims, 5 Drawing Sheets

PERSONAL WATERCRAFT

BACKGROUND OF THE INVENTION

Technical Field

An aspect of the present disclosure relates to a personal watercraft.

Description of the Related Art

Personal watercrafts are widely used for various purposes, such as for leisure activities, sport activities, and rescue activities. There is a known personal watercraft that includes a light emitter mounted on the body of the personal watercraft and configured to emit light when the personal watercraft is in operation (see U.S. Pat. No. 5,850,803 A, for example).

SUMMARY OF THE INVENTION

A personal watercraft according to an aspect of the present disclosure includes: a watercraft body including a hull and a deck covering an upper portion of the hull; a light emitter supported by the watercraft body; and a protection cover covering the light emitter and permeable to light emitted by the light emitter, wherein the watercraft body includes a flow-regulating structure, and the flow-regulating structure includes: a fluid inlet through which an external fluid enters the watercraft body; and an upper flow-regulating wall and a lower flow-regulating wall that are opposed to each other in an up-down direction, the upper and lower flow-regulating walls being located between the fluid inlet and the protection cover to regulate flow of the fluid entering the watercraft body through the fluid inlet and moving toward the protection cover.

In the above configuration, the flow of the fluid entering the watercraft body through the fluid inlet and moving toward the protection cover is regulated by the upper and lower flow-regulating walls. Thus, the angle of the direction of fluid flow toward the protection cover with respect to the horizontal plane is controlled. This makes it easier to design a light emitter-protecting structure capable of withstanding winds and waves.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, exemplary embodiments will be described with reference to the drawings.

Figure 1:
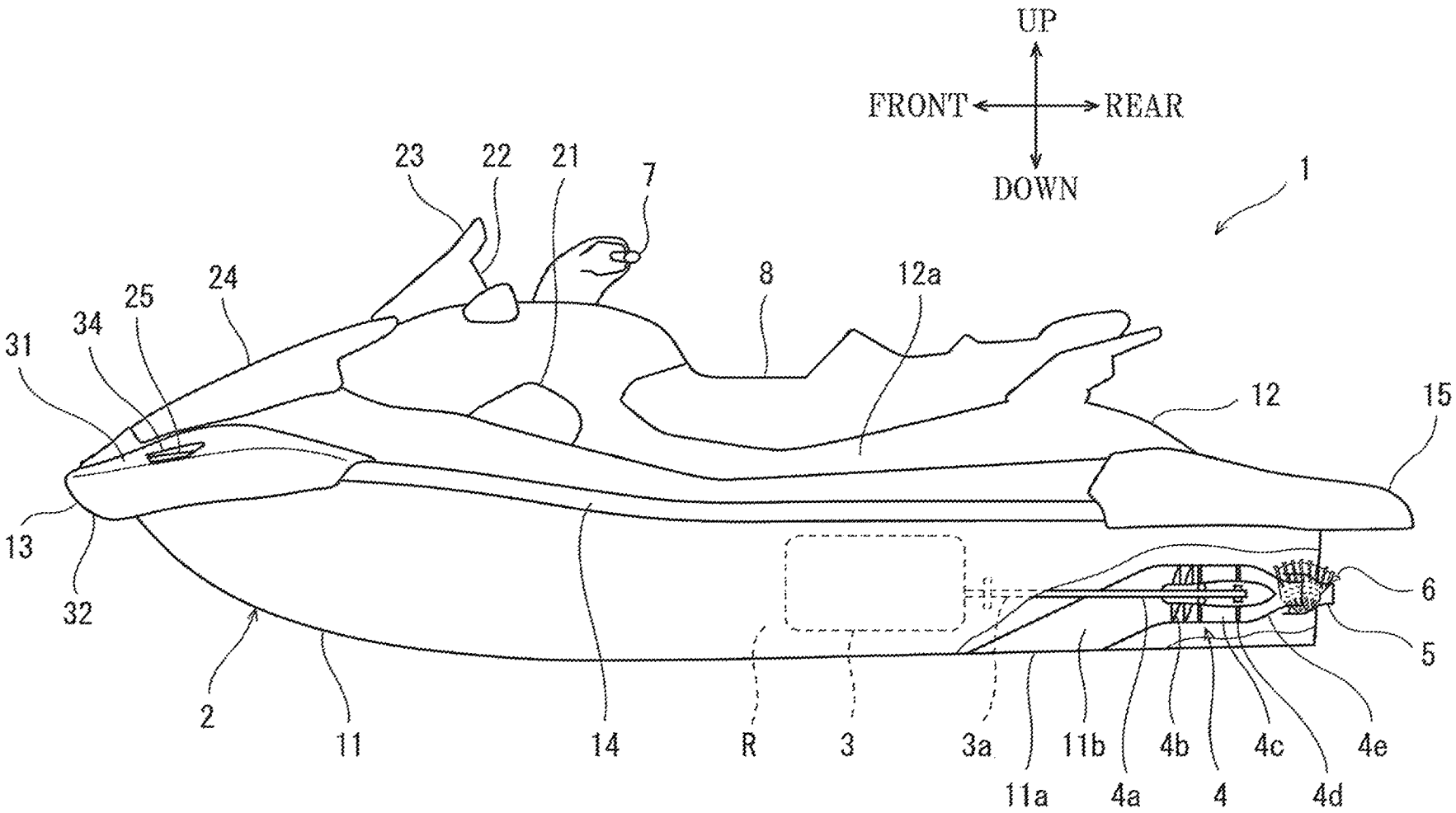
FIG. 1 is a partially cutaway side view of a personal watercraft according to an exemplary embodiment.
Figure 2:
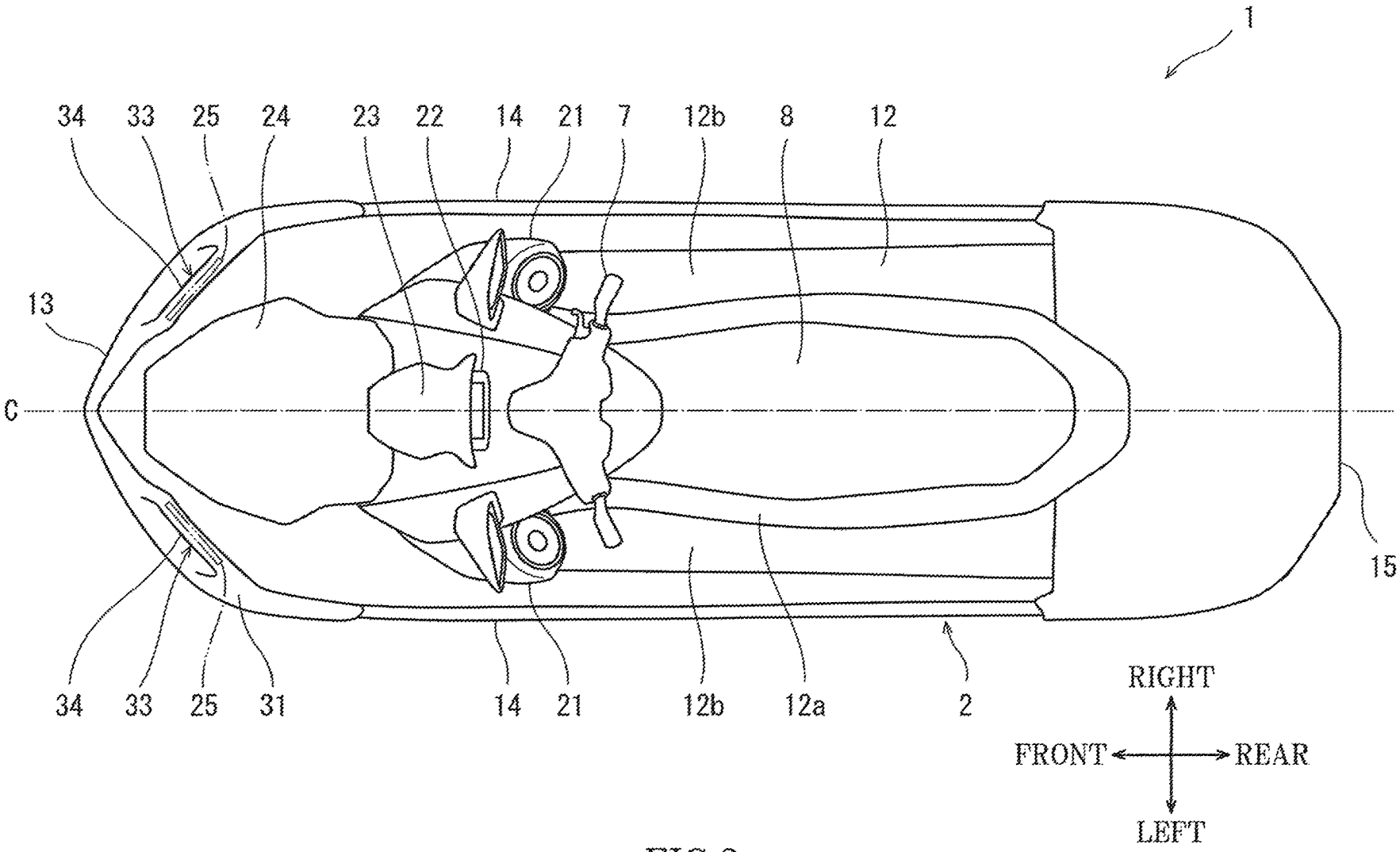
FIG. 2 is a top view of the personal watercraft of FIG. 1.
Figure 3:
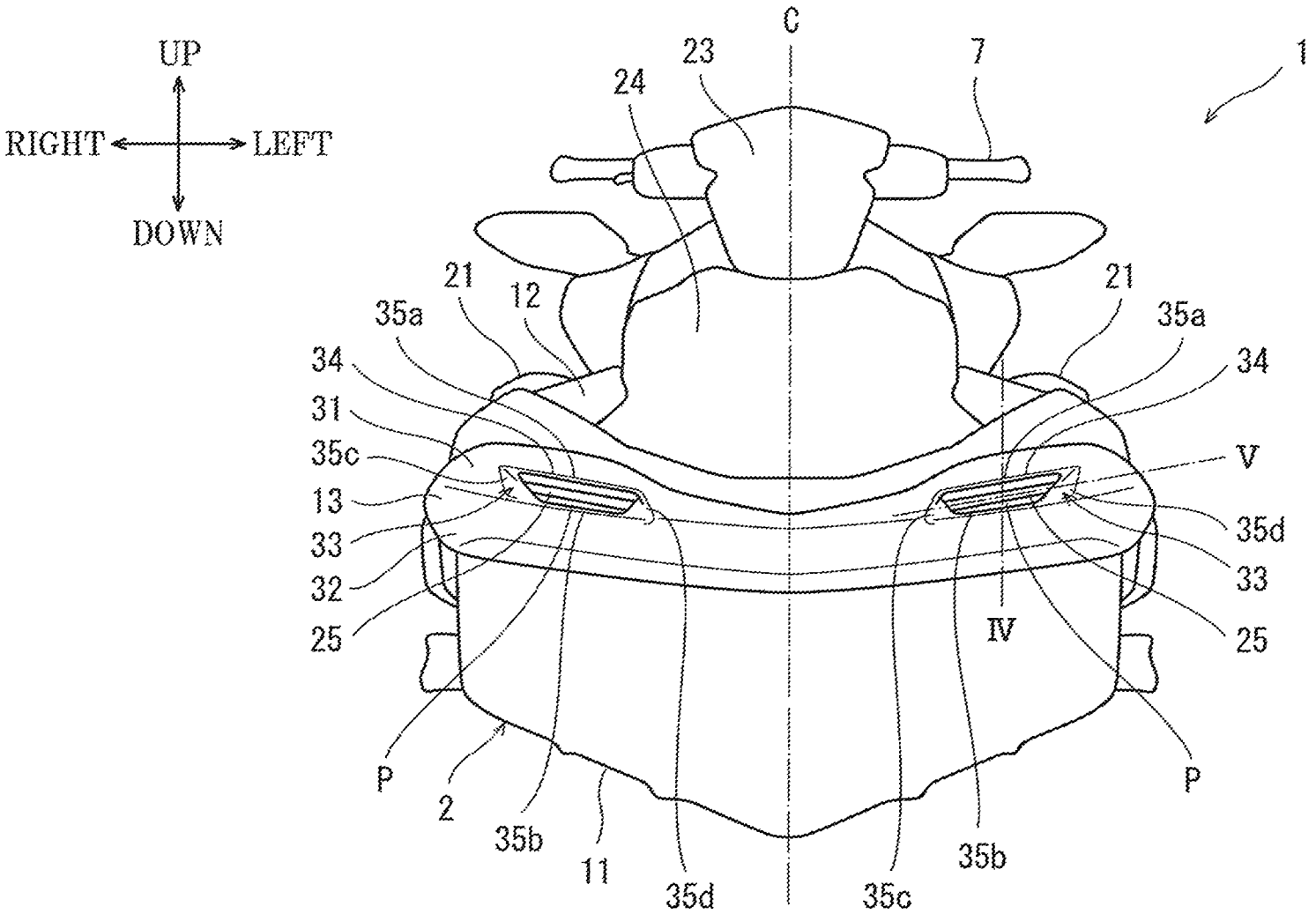
FIG. 3 is a front view of the personal watercraft of FIG. 1.

FIG. 1 is a partially cutaway side view of a personal watercraft 1 according to an exemplary embodiment. FIG. 2 is a top view of the personal watercraft 1 of FIG. 1. FIG. 3 is a front view of the personal watercraft 1 of FIG. 1. The personal watercraft 1 includes a watercraft body 2. The directions mentioned in the following description are those coinciding with the directions in which the operator sitting on a seat 8 described later faces. The vertically up-down direction and the transverse direction with respect to the watercraft body 2 at rest on the water will be respectively referred to as the "vertical direction" and the "horizontal direction" of the watercraft body 2. The phrase "toward the inside of the watercraft body 2" as used herein refers to a direction toward the center of the watercraft body 2. The phrase "toward the outside of the watercraft body 2" as used herein refers to a direction away from the center of the watercraft body 2. The right-left direction transverse to the direction of the forward movement of the watercraft body 2 may be referred to as the "watercraft body width direction".

The watercraft body 2 includes a hull 11 and a deck 12 covering the upper portion of the hull 11. Referring to FIG. 1, the interior of the watercraft body 2 includes an engine room R, in which an engine 3 serving as a prime mover is accommodated. The output shaft of the engine 3 is connected to a propeller shaft 3*a* extending rearward. The rear end of the propeller shaft 3*a* is connected to a pump shaft 4*a* of a water jet pump 4 located in the rear of the hull 11. An impeller 4*b* is mounted on the pump shaft 4*a*. A stator vane 4*c* is located rearward of the impeller 4*b*. A pump casing 4*d* is located radially outward of the impeller 4*b* and encloses the impeller 4*b*.

A water inlet 11*a* opens at the bottom of the hull 11. The water inlet 11*a* and the pump casing 4*d* are in communication via a water passage 11*b*. The pump casing 4*d* is provided with a pump nozzle 4*e* facing rearward of the watercraft body 2. The pump nozzle 4*e* decreases in diameter from front to rear, and an ejection orifice opens at the rear end of the pump nozzle 4*e*. To the ejection orifice of the pump nozzle 4*e* is connected a steering nozzle 5 which is swingable in the right-left direction. A bowl-shaped reverse bucket 6 is located in the vicinity of the steering nozzle 5. The reverse bucket 6 is pivotally supported by the hull 11 and pivotable between an advanced position where the reverse bucket 6 covers the ejection orifice of the steering nozzle 5 from behind to cause water ejected from the pump nozzle 4*e* to be redirected forward and a retracted position where the reverse bucket 6 allows the ejection orifice of the steering nozzle 5 to be open in the rearward direction.

In the personal watercraft 1, water drawn into the hull 11 through the water inlet 11*a* located at the bottom of the hull 11 is pressurized and accelerated by rotational power of the impeller 4*b* of the water jet pump 4 driven by the engine 3. The flow of water is regulated by the stator vane 4*c* and ejected rearward through the ejection orifice of the pump nozzle 4*e* and the steering nozzle 5 to produce propulsion power. A bar-shaped handle 7 is located above the front of the deck 12 and rotatably supported by the deck 12. When the operator tilts the handle 7 to the right or left, the steering nozzle 5 swings to the right or left in conjunction with the tilting movement of the handle 7.

The deck 12 includes a seat support 12*a* and a pair of foot rests 12*b*. The seat support 12*a* is located rearward of the handle 7 and projects upward from the deck floor on which users can walk. Referring to FIG. 2, the two foot rests 12*b* are located to the right and left of the seat support 12*a*, respectively. The foot rests 12*b* constitute a part of the deck floor. The seat 8 is located rearward of the handle 7, and the seat support 12*a* supports the seat 8 from below. The seat 8 is a straddle seat on which a user sits in a straddling position. A speaker 21 is mounted on a front end portion of each foot rest 12*b*.

In the deck 12, a meter device 22 is disposed forward of the handle 7. The meter device 22 is covered from above by a meter cover 23. An openable hatch cover 24 is disposed forward of the meter cover 23.

Two light units 25 are disposed on a front end portion of the watercraft body 2. As seen from FIGS. 2 and 3, the two light units 25 are spaced apart from each other in the right-left direction. The two light units 25 are symmetrical with respect to a center plane C dividing the watercraft body 2 into right and left halves.

The watercraft body 2 includes a front bumper 13, two side bumpers 14, and a rear bumper 15. The bumpers 13, 14, and 15 are placed to cover the region where the hull 11 and the deck 12 are connected. The front bumper 13 is located forward of the hatch cover 24. The front bumper 13 is located forward of and covers the front end portions of the hull 11 and the deck 12. The side bumpers 14 are located lateral to and cover the side edge portions of the hull 11 and the deck 12. The rear bumper 15 is located rearward of and covers the rear end portions of the hull 11 and the deck 12. Each of the bumpers 13, 14, and 15 is made of an elastically deformable material. For example, when exposed to an external force such as that arising from collision with an object floating on the water, the bumpers 13, 14, and 15 are elastically deformed (bent) to absorb the external force.

The front bumper 13 includes an outer upper wall 31 facing obliquely forward and upward and an outer lower wall 32 facing obliquely forward and downward. As seen from FIG. 2, the front bumper 13 extends rearward with increasing distance from the center plane C of the watercraft body 2. Thus, each of the outer upper and lower walls 31 and 32 has a right portion located to the right of the center plane C and facing obliquely forward and rightward and a left portion located to the left of the center plane C and facing obliquely forward and leftward.

The front bumper 13 is placed to surround the peripheries of the two light units 25. As seen from FIG. 3, the two light units 25 as viewed from the front are located between the upper and lower edges of the front bumper 13 in the up-down direction and located between the right and left edges of the front bumper 13 in the right-left direction. The front bumper 13 is provided with two light passageways P through which light emitted forward from the two light units 25 passes. The two light passageways P are spaced apart from each other in the right-left direction in such a manner that the two light passageways P respectively overlap the two light units 25 in front view.

In the present embodiment, each light passageway P is formed such that fluids such as air and water can spontaneously enter the light passageway P from outside the watercraft body 2 (in particular, from outside the front bumper 13). A fluid entering the light passageway P from outside the watercraft body 2 collides with the light unit 25. The front bumper 13 includes a flow-regulating structure 33 that regulates the flow of a fluid entering the light passageway P from outside the watercraft body 2 (in particular, from outside the front bumper 13) and moving toward the light unit 25 through the light passageway P.

The flow-regulating structure 33 is configured to allow a fluid coming from outside the watercraft body 2 to collide with the light unit 25 in a predetermined direction. The flow-regulating structure 33 includes a fluid inlet 34, an upper flow-regulating wall 35*a*, a lower flow-regulating wall 35*b*, a right flow-regulating wall 35*c*, and a left flow-regulating wall 35*d*.

The fluid inlet 34 is an opening formed in the outer upper wall 31. The fluid coming from outside the watercraft body 2 enters the light passageway P through the fluid inlet 34. In the present embodiment, the fluid inlet 34 serves as the entrance to the light passageway P for the fluid coming from outside the watercraft body 2 and as the exit from the light passageway P for light emitted by the light unit 25.

The flow-regulating structure 33 constituting a part of the front bumper 13 is located around the light unit 25 and configured to project in a horizontal direction (the forward direction in this example) toward the outside of the watercraft body 2 and surround the periphery of the light unit 25. When seen from outside the watercraft body 2, the light unit 25 (in particular, a protection cover 42 described later) is visible only through the fluid inlet 34. When a fluid is coming from outside the watercraft body 2 (in particular, from outside the front bumper 13), that portion of the fluid which enters the light passageway P through the fluid inlet 34 is directed to the light unit 25, while the rest of the fluid is prevented by the flow-regulating structure 33 from flowing toward the light unit 25.

The upper flow-regulating wall 35*a* and the lower flow-regulating wall 35*b* are opposed to each other in the up-down direction. The upper and lower flow-regulating walls 35*a* and 35*b* are located between the fluid inlet 34 and the light unit 25 (in particular, the protection cover 42). The upper and lower flow-regulating walls 35*a* and 35*b* regulate the flow of a fluid entering the light passageway P through the fluid inlet 34 and moving toward the light unit 25. In other words, the fluid entering the light passageway P through the fluid inlet 34 is guided by the upper and lower flow-regulating walls 35*a* and 35*b* to pass between the upper and lower flow-regulating walls 35*a* and 35*b* toward the light unit 25.

The right flow-regulating wall 35*c* and the left flow-regulating wall 35*d* are opposed to each other in the right-left direction. The right and left flow-regulating walls 35*c* and 35*d* are located between the fluid inlet 34 and the light unit 25 (in particular, the protection cover 42). The right and left flow-regulating walls 35*c* and 35*d* regulate the flow of a fluid entering the light passageway P through the fluid inlet 34 and moving toward the light unit 25. In other words, the fluid entering the light passageway P through the fluid inlet 34 is guided by the right and left flow-regulating walls 35*c* and 35*d* to pass between the right and left flow-regulating walls 35*c* and 35*d* toward the light unit 25.

The configuration of that part of the personal watercraft 1 which is in the vicinity of the left light unit 25 will be described in detail with reference to FIGS. 4 and 5. The configuration of that part of the personal watercraft 1 which is in the vicinity of the right light unit 25 will not be described because the configuration of the part which is in the vicinity of the left light unit 25 and the configuration of the part which is in the vicinity of the right light unit 25 are symmetrical with respect to the center plane C of the watercraft body 2.

Figure 4:
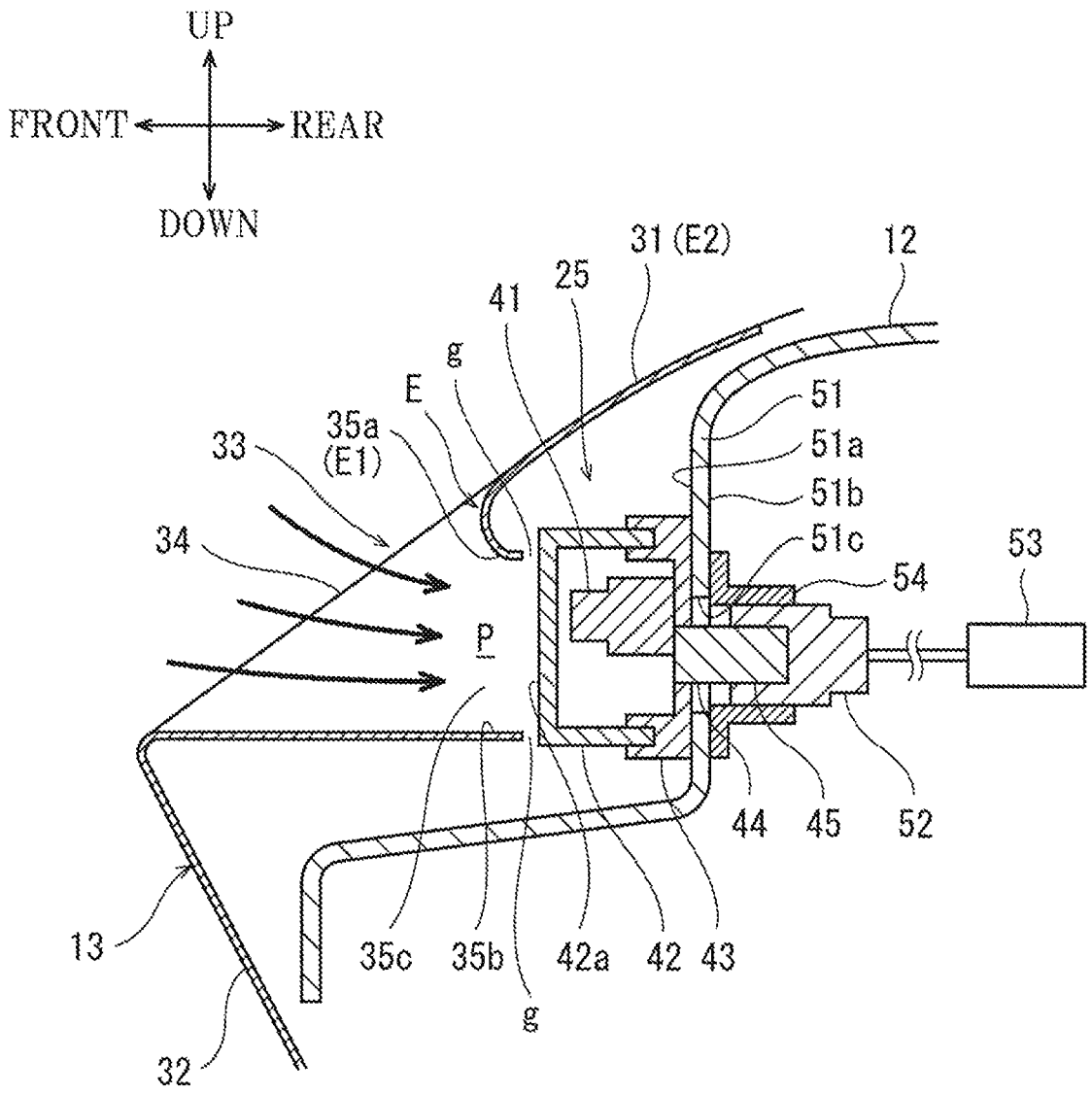
FIG. 4 is a partial side view of the personal watercraft showing a left light unit and its vicinity in vertical cross-section taken along the plane IV of FIG. 3.

FIG. 4 is a partial side view of the personal watercraft 1 showing the left light unit 25 and its vicinity in vertical cross-section taken along the plane IV of FIG. 3. FIG. 5 is a partial left front perspective view of the personal watercraft 1 showing the left light unit 25 and its vicinity in cross-section taken along the plane V of FIG. 3. In FIG. 5, the flow-regulating walls 35*b*, 35*c*, and 35*d* are indicated by dashed-two dotted lines.

The deck 12 includes a mounting wall 51 on which the light unit 25 (in particular, a base 43 described later) is mounted. The mounting wall 51 includes a first wall surface 51*a* which is a flat surface facing toward the outside of the watercraft body 2 and a second wall surface 51*b* which is a flat surface facing toward the inside of the watercraft body 2. The light unit 25 is mounted on the first wall surface 51*a* of the mounting wall 51.

The light unit 25 is made up of a plurality of light emitters 41, a protection cover 42, a base 43, and a light-side connector 45 which are integrated into a single unit. The light unit 25 is in an elongated shape extending longitudinally in the right-left direction (see also FIG. 2). Specifically, the mounting wall 51 extends rearward with increasing distance from the center plane C of the watercraft body 2, and the light unit 25 is placed on the mounting wall 51 in such a position that the longitudinal direction of the light unit 25 coincides with the direction in which the mounting wall 51 extends.

Each light emitter 41 is, for example, a light-emitting diode (LED). The light emitter 41 need not be an LED and may be any existing light-emitting source. For example, the light emitter 41 may be an incandescent lamp or an organic or inorganic electro-luminescent (EL) element. The light emitters 41 are supported by the base 43 on the watercraft body 2. The light emitters 41 are not limited to a particular manner of arrangement. For instance, as in the illustrated example, the light emitters 41 may be arranged in a straight line extending in the right-left direction. The light emitters 41 may be spaced apart from one another. The light unit 25 need not include two or more light emitters 41 and may include only one light emitter 41.

The protection cover 42 covers the plurality of light emitters 41 from outside the watercraft body 2, in particular from the front. The protection cover 42 is permeable to light emitted by the light emitters 41 and impermeable to water and air. The protection cover 42 is made of, for example, a transparent or semi-transparent resin. The protection cover 42 is generally in the shape of a box opening toward the inside of the watercraft body 2. For example, as shown in FIGS. 4 and 5, the protection cover 42 is U-shaped in both horizontal and vertical sections. The protection cover 42 has an outer surface 42*a* facing toward the fluid inlet 34, and the outer surface 42*a* is generally perpendicular to the horizontal plane as shown in FIG. 4. The outer surface 42*a* extends rearward with increasing distance from the center plane C of the watercraft body 2. A fluid entering the light passageway P through the fluid inlet 34 collides with the outer surface 42*a*. Thus, to ensure the pressure resistance of that portion of the protection cover 42 which faces toward the fluid inlet 34, this portion is formed to be thicker than the rest of the protection cover 42.

The base 43 connects and secures the light emitters 41 and the protection cover 42 to the deck 12. Specifically, the base 43 is located between the mounting wall 51 of the deck 12 and the light emitters 41. The base 43 includes a first base surface which is a flat surface facing toward the inside of the watercraft body 2 and a second base surface which is a flat surface facing toward the outside of the watercraft body 2. The first base surface is a flat surface which is in contact with the first wall surface 51*a* of the mounting wall 51. The first base surface need not be a flat surface and may be any surface conforming to the first wall surface 51*a*.

The base 43 is secured to the mounting wall 51 by fasteners, with the first base surface and the first wall surface 51*a* being in surface contact. For example, the fasteners include: stud bolts 43*b* inserted through holes provided in the mounting wall 51 of the deck 12 and holes provided in right and left ends of the base 43; and nuts (not shown) threaded on the stud bolts 43*b*.

The light emitters 41 are secured to the second base surface. The second base surface is provided with a joining portion which surrounds the light emitters 41 when viewed in a direction perpendicular to the second base surface. The joining portion is where the protection cover 42 is joined to the base 43. For example, as shown in FIGS. 4 and 5, the joining portion includes a groove in which the opening edge of the protection cover 42 is fitted. The joining of the protection cover 42 to the base 43 is accomplished by vibration welding performed with the opening edge of the protection cover 42 fitted in the groove.

The mounting wall 51 is provided with a through hole 51*c*. The base 43 is provided with a projecting portion 44 projecting from the first base surface of the base 43 toward the inside of the watercraft body 2, the projecting portion 44 being inserted through the through hole 51*c*. The projecting portion 44 is provided with the light-side connector 45. The projecting portion 44 may be integral with the base 43 or light-side connector 45 or may be an entity separate from the base 43 and the light-side connector 45. The light-side connector 45 is connected to a watercraft body-side connector 52 described later. The projecting portion 44 is configured to establish electrical connection between the light-side connector 45 and the light emitters 41. Specifically, the projecting portion 44 includes a conductor electrically connecting the light-side connector 45 to the light emitters 41.

Referring to FIG. 4, the watercraft body-side connector 52 and an electric power supply 53 electrically connected to the watercraft body-side connector 52 are disposed in the interior of the watercraft body 2, namely in the space lying between the hull 11 and the deck 12 in the up-down direction.

The watercraft body-side connector 52 is secured to the deck 12 (for example, to the second wall surface 51*b* of the mounting wall 51) by, for example, a fastening member 54. The light unit 25 is placed on the first wall surface 51*a* of the mounting wall 51 in such a manner that the projecting portion 44 is inserted through the through hole 51*c*. Thus, the light-side connector 45 and the watercraft body-side connector 52 are connected to enable supply of electric power from the electric power supply 53 to the light emitters 41.

In FIG. 4, the electric power supply 53 is schematically shown as a block. The electric power supply 53 need not be located in the vicinity of the light unit 25. The electric power supply 53 supplies electric power not only to the left light unit 25 but also to the right light unit 25. The electric power supply 53 is, for example, a controller for controlling the engine 3. When, for example, the engine 3 is running, the electric power supply 53 supplies electric power to the light emitters 41 and allows the light emitters 41 to emit light. Two electric power supplies 53 may be provided respectively for the right and left light units 25. The electric power supply 53 need not be the controller for controlling the engine 3, and may be a battery separate from the controller.

Referring to FIG. 4, the upper flow-regulating wall 35*a* and a portion of the outer upper wall 31 constitute an overhang E projecting toward the outside of the watercraft body 2. Hereinafter, the upper flow-regulating wall 35*a* may be referred to as "overhang lower portion E1", and that portion of the upper wall 31 which is included in the overhang E may be referred to as "overhang upper portion E2". The front end of the overhang upper portion E2 is connected to the front end of the overhang lower portion E1 which is the upper flow-regulating wall 35*a*. The overhang upper portion E2 lies above the overhang lower portion E1 and extends obliquely upward from the front end of the overhang lower portion E1 toward the inside of the watercraft body 2 to cover the upper portion of the protection cover 42. Thus, the light unit 25 is invisible when viewed from above (see FIG. 2).

As shown in FIG. 4, the upper flow-regulating wall 35*a* is inclined downward in the rearward direction. While the upper flow-regulating wall 35*a* as shown in FIG. 4 is curved in side view, the upper flow-regulating wall 35*a* may be made up of a plurality of flat plates coupled together such that the angle of the upper flow-regulating wall 35*a* with respect to the horizontal plane decreases in the rearward direction. Alternatively, the upper flow-regulating wall 35*a* may be embodied by a single flat plate positioned at a fixed angle with respect to the horizontal plane.

The lower flow-regulating wall 35*b* is shaped to be generally parallel to the horizontal plane. The lower flow-regulating wall 35*b* may be inclined upward in the rearward direction. The lower flow-regulating wall 35*b* may be made up of a plurality of flat plates coupled together such that the angle of the lower flow-regulating wall 35*b* with respect to the horizontal plane decreases in the rearward direction. Alternatively, the lower flow-regulating wall 35*b* may be embodied by a single flat plate positioned at a fixed angle with respect to the horizontal plane.

The rear edges of the upper and lower flow-regulating walls 35*a* and 35*b* overlap the outer surface 42*a* of the protection cover 42 in front view. In other words, as shown in FIG. 4, the rear edge of the upper flow-regulating wall 35*a* is located below the upper edge of the outer surface 42*a* of the protection cover 42, while the rear edge of the lower flow-regulating wall 35*b* is located above the lower edge of the outer surface 42*a* of the protection cover 42.

The upper and lower flow-regulating walls 35*a* and 35*b* regulate the flow of a fluid entering the light passageway P through the fluid inlet 34 and moving toward the protection cover 42. Thus, the direction in which the fluid entering the light passageway P through the fluid inlet 34 flows toward the protection cover 42 is controlled. More specifically, the angle of the direction of fluid flow from the fluid inlet 34 toward the protection cover 42 with respect to the horizontal plane is controlled by the upper and lower flow-regulating walls 35*a* and 35*b*.

Figure 5:
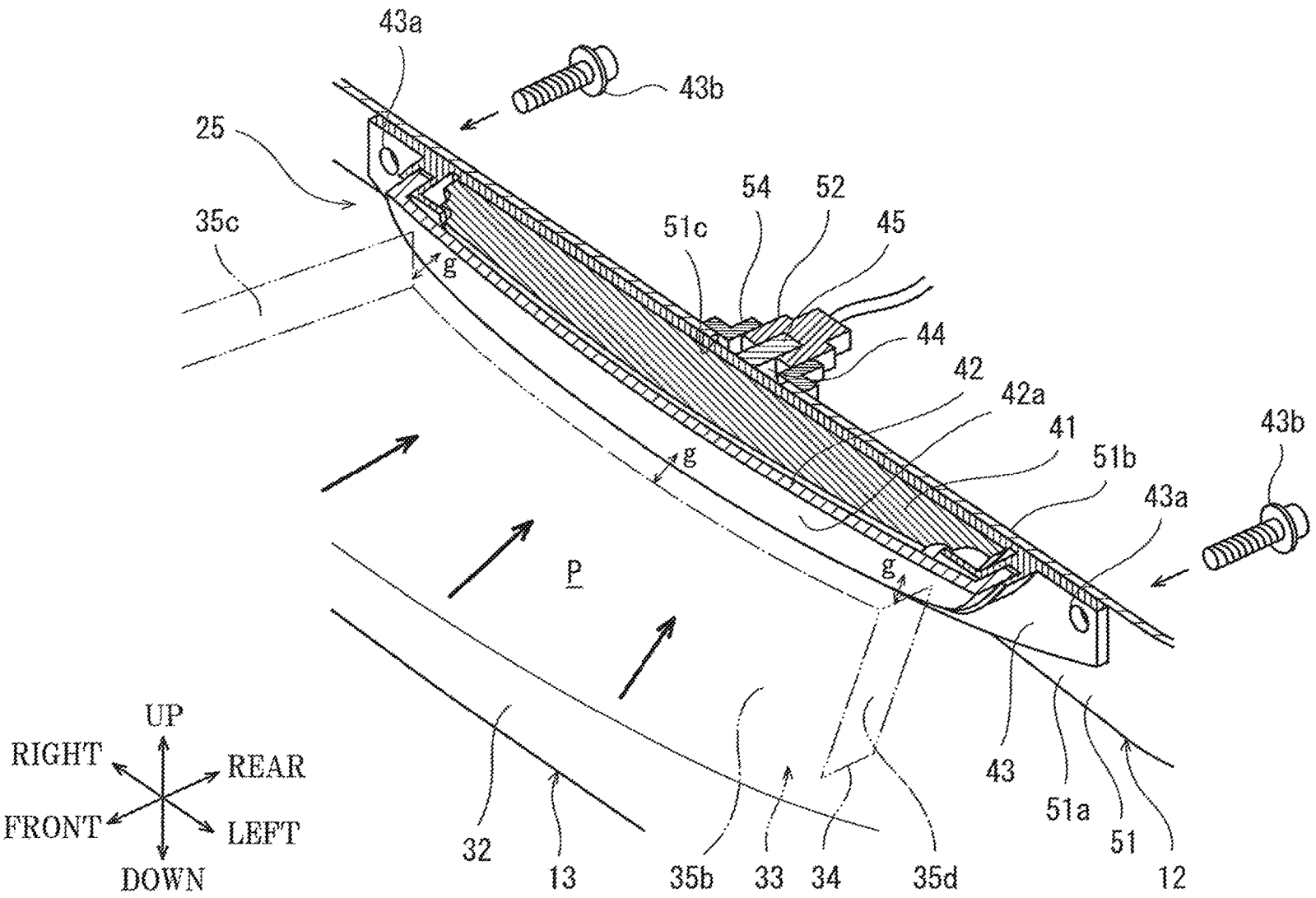
FIG. 5 is a partial left front perspective view of the personal watercraft showing the left light unit and its vicinity in cross-section taken along the plane V of FIG. 3.

As seen from FIG. 5, the right flow-regulating wall 35*c*, which is located closer to the center of the watercraft body 2 in the watercraft body width direction than the left flow-regulating wall 35*d*, is shaped to be generally parallel to the horizontal plane. Alternatively, the right flow-regulating wall 35*c* may be inclined to extend obliquely rearward toward the outside of the watercraft body 2 in the watercraft body width direction.

The left flow-regulating wall 35*d*, which is located outward of the right flow-regulating wall 35*c* in the watercraft body width direction, is inclined to extend obliquely rearward toward the center of the watercraft body 2. The right flow-regulating wall 35*c* may be made up of a plurality of flat plates coupled together such that the angle of the right flow-regulating wall 35*c* with respect to a plane perpendicular to the first wall surface 51*a* decreases in the rearward direction. Alternatively, the right flow-regulating wall 35*c* may be embodied by a single flat plate positioned at a fixed angle with respect to the plane perpendicular to the first wall surface 51*a*.

The rear edges of the right and left flow-regulating walls 35*c* and 35*d* overlap the outer surface 42*a* of the protection cover 42 when viewed in a direction perpendicular to the first wall surface 51*a*. In other words, as seen from FIG. 5, the rear edge of the right flow-regulating wall 35*c* is located to the left of the right edge of the outer surface 42*a* of the protection cover 42, and the rear edge of the left flow-regulating wall 35*d* is located to the right of the left edge of the outer surface 42*a* of the protection cover 42.

The right and left flow-regulating walls 35*c* and 35*d* regulate the flow of a fluid entering the light passageway P through the fluid inlet 34 and moving toward the protection cover 42. Thus, the direction in which the fluid entering the light passageway P through the fluid inlet 34 flows toward the protection cover 42 is controlled. More specifically, the angle of the direction of fluid flow from the fluid inlet 34 toward the protection cover 42 with respect to the vertical plane (e.g., a plane perpendicular to the first wall surface 51*a*) is controlled by the right and left flow-regulating walls 35*c* and 35*d*.

A gap g is provided between the protection cover 42 and the rear edge of each of the flow-regulating walls 35*a*, 35*b*, 35*c*, and 35*d* in the front-rear direction (in particular, the direction perpendicular to the first wall surface 51*a*). The size of the gap g between the protection cover 42 and the rear edge of each of the flow-regulating walls 35*a*, 35*b*, 35*c*, and 35*d* need not be constant, and there may be a difference between the distance from one portion of the rear edge to the protection cover 42 and the distance from another portion of the rear edge to the protection cover 42. The size of the gap g in the direction perpendicular to the first wall surface 51*a* is, for example, 10 mm or less and preferably 5 mm or less.

The gap g serves as an exit for a fluid entering the light passageway P through the fluid inlet 34. For example, a fluid entering the light passageway P through the fluid inlet 34 during forward movement of the personal watercraft 1 passes through the gap g and flows rearward along the outer surface of the deck 12. When the front bumper 13 is subjected to an external force, transmission of the external force from the front bumper 13 to the protection cover 42 can be reduced since the front bumper 13 and the protection cover 42 are spaced apart.

In the configuration described above, the flow-regulating structure 33 controls the angle of the direction of fluid flow toward the protection cover 42 with respect to the horizontal and vertical planes. This makes it easier to design a protection structure for the light emitters 41 which is capable of withstanding winds and waves.

Additionally, since the overhang E of the front bumper 13 covers the upper portion of the protection cover 42, the direction of flow of a fluid coming from above and moving toward the protection cover 42 can be controlled.

Additionally, since the outer surface 42*a* of the protection cover 42, which faces toward the fluid inlet 34, extends perpendicular to the horizontal plane when the watercraft body 2 is at rest on the water, the variety of possible directions in which loads can be applied to the protection cover 42 is reduced. This allows for a simplified design of the load bearing structure of the protective member for the light emitters 41.

Additionally, in the present embodiment, the flow-regulating structure 33 is provided in the front bumper 13. This eliminates the need for additionally mounting a member including the flow-regulating structure 33 on the watercraft body 2. Further, the front bumper 13 can prevent contact of objects floating on the water with the protection cover 42.

Additionally, since the outer surface 42*a* of the protection cover 42, which faces toward the fluid inlet 34, extends rearward with increasing distance from the center plane C dividing the watercraft body 2 into right and left halves, a fluid colliding with the front of the protection cover 42 during forward movement of the personal watercraft 1 can easily be directed rearward. This can reduce the pressure applied to the protection cover 42 by the fluid.

Additionally, since the light emitters 41, the protection cover 42, and the base 43 are integrated into a light unit, the light emitters 41 and the protection cover 42 are easy to mount on the watercraft body 2.

Additionally, the base 43 is secured to the mounting wall 51 with the first base surface of the base 43 in contact with the first wall surface 51*a* of the mounting wall 51. Thus, a load applied to the protection cover 42 from a fluid is borne by the surface of the deck 12 via the base 43. This allows for a protection structure for the light emitters 41 which exhibits an increased strength against fluids.

Additionally, since the watercraft body-side connector 52 and the light-side connector 45 are located in the interior of the watercraft body 2, namely in the space lying between the hull 11 and the deck 12, the watercraft body-side connector 52 and the light-side connector 45 can be reliably protected.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

For example, while in the embodiment described above the flow-regulating structure 33 includes four flow-regulating walls 35*a*, 35*b*, 35*c*, and 35*d*, the flow-regulating structure 33 need not include the right and left flow-regulating walls 35*c* and 35*d*. When the flow-regulating structure 33 does not include the right and left flow-regulating walls 35*c* and 35*d*, the fluid inlet 34 may be in the shape of a slit extending in the right-left direction. Even in this case, the flow-regulating structure 33 including the upper and lower flow-regulating walls 35*a* and 35*b* controls the angle of the direction of fluid flow toward the protection cover 42 at least with respect to the horizontal plane. This makes it easier to design a protection structure for the light emitters 41 which is capable of withstanding winds and waves. Likewise, the flow-regulating structure 33 need not include the upper and lower flow-regulating walls 35*a* and 35*b*. When the flow-regulating structure 33 does not include the upper and lower flow-regulating walls 35*a* and 35*b*, the fluid inlet 34 may be in the shape of a slit extending in the up-down direction. Even in this case, the flow-regulating structure 33 including the right and left flow-regulating walls 35*c* and 35*d* controls the angle of the direction of fluid flow toward the protection cover 42 at least with respect to the vertical plane (e.g., a plane perpendicular to the first wall surface 51*a*). This makes it easier to design a protection structure for the light emitters 41 which is capable of withstanding winds and waves.

The light emitters 41 and protection cover 42 need not be disposed on the front end portion of the watercraft body 2, and may be disposed, for example, on the side edge portion or rear end portion of the watercraft body 2. The flow-regulating structure 33 may be provided in the side bumper 14 or rear bumper 15, instead of or in addition to being provided in the front bumper 13. That is, the flow-regulating structure 33 is not limited to a structure which controls the direction of flow of a fluid coming from the front of the watercraft body 2 and moving toward the protection cover 42, and may be a structure which controls the direction of flow of a fluid coming from the side or rear of the watercraft body 2 and moving toward the protection cover 42. In this case, the gap g between the protection cover 42 and that edge of each of the flow-regulating walls 35*a*, 35*b*, 35*c*, and 35*d* which faces toward the inside of the watercraft body 2 need not be provided in the front-rear direction, and may be provided in a direction toward the center of the watercraft body 2 (e.g., a direction perpendicular to the outer surface 42*a* of the protection cover 42). There may be no gap between the protection cover 42 and that edge of each of the flow-regulating walls 35*a*, 35*b*, 35*c*, and 35*d* which faces toward the inside of the watercraft body 2.

While in the embodiment described above the flow-regulating structure 33 is provided in the front bumper 13, the flow-regulating structure 33 may be provided in none of the bumpers 13, 14, and 15. For example, the watercraft body 2 may include a member distinct from the bumpers and including the flow-regulating structure 33. The side bumper 14 is smaller in size in the up-down direction than the front bumper 13 and the rear bumper 15 and, in some cases, the size of the side bumper 14 in the up-down direction is so small that the side bumper 14 cannot cover the protection cover 42. Thus, if the flow-regulating structure 33 is provided in a side edge portion of the watercraft body 2, it is preferable that a member distinct from the side bumper 14 and including the flow-regulating structure 33 be additionally provided in the deck 12 or hull 11. The flow-regulating structure 33 need not be provided in a member to be secured to the deck 12 and, for example, the deck 12 itself may include the flow-regulating structure 33.

The outer surface 42*a* of the protection cover 42 may be inclined with respect to the vertical direction. For example, the outer surface 42*a* of the protection cover 42, which faces toward the fluid inlet 34, may be inclined with respect to the vertical direction when the watercraft body 2 is at rest on the water. In this case, the angle of inclination of the outer surface 42*a* with respect to the vertical direction is preferably 10 degrees or less. With such an angle of inclination, the outer surface 42*a* of the protection cover 42 which faces toward the fluid inlet 34 can be positioned to extend substantially in the vertical direction. Thus, the variety of possible directions in which loads can be applied to the protection cover 42 is reduced. This allows for a simplified design of the load bearing structure of the protective member for the light emitters 41.

The light units 25 need not be located between the upper and lower edges of the front bumper 13 in the up-down direction. It is particularly preferable to provide the flow-regulating structure 33 when in the personal watercraft 1 the protection cover 42 and/or the light emitters 41 are located at a height where they might be exposed to waves or wave splashes, such as when the protection cover 42 and/or the light emitters 41 are located below the highest point of the upper surface of the seat 8 in side view.

The outer surface 42*a* of the protection cover 42, which faces toward the fluid inlet 34, may be parallel or perpendicular to the center plane C of the watercraft body 2 in top view.

The light emitters 41, the protection cover 42, and the base 43 need not be integrated into a light unit. For example, a base supporting the light emitters 41 and a base supporting the protection cover 42 may be separately provided, and these bases may be individually secured to the deck 12.

The deck 12 need not include the mounting wall 51 on which the base 43 is mounted, and the base 43 may be mounted on a member supported by the deck 12.

What is claimed is:

1. A personal watercraft comprising:

a watercraft body comprising a hull and a deck covering an upper portion of the hull;

a light emitter supported by the watercraft body; and a protection cover covering the light emitter and permeable to light emitted by the light emitter, wherein the watercraft body comprises a flow-regulating structure, and the flow-regulating structure comprises:

a fluid inlet through which an external fluid enters the watercraft body; and an upper flow-regulating wall and a lower flow-regulating wall that are opposed to each other in an up-down direction, the upper and lower flow-regulating walls being located between the fluid inlet and the protection cover to regulate flow of the fluid entering the watercraft body through the fluid inlet and moving toward the protection cover.

2. The personal watercraft according to claim 1, wherein the flow-regulating structure is located around the protection cover and configured to project in a horizontal direction toward an outside of the watercraft body and surround a periphery of the protection cover.

3. The personal watercraft according to claim 1, wherein the watercraft body comprises an overhang projecting toward an outside of the watercraft body, and the overhang comprises:

an overhang lower portion included in the upper flow-regulating wall; and an overhang upper portion connected to a front end of the overhang lower portion and lying above the overhang lower portion, the overhang upper portion extending obliquely upward from the front end of the overhang lower portion toward an inside of the watercraft body to cover an upper portion of the protection cover.

4. The personal watercraft according to claim 1, wherein the protection cover has an outer surface facing toward the fluid inlet, and an angle of inclination of the outer surface with respect to a vertical direction is 10 degrees or less when the watercraft body is at rest on water.

5. The personal watercraft according to claim 1, wherein the watercraft body comprises a bumper covering a region where the hull and the deck are connected, and the flow-regulating structure is provided in the bumper.

6. The personal watercraft according to claim 1, wherein the flow-regulating structure is located at a front end portion of the watercraft body, the protection cover has an outer surface facing toward the fluid inlet, and the outer surface extends rearward with increasing distance from a center plane diving the watercraft body into right and left halves.

7. The personal watercraft according to claim 1, further comprising:

a handle located above the deck; and a straddle seat located rearward of the handle, wherein the light emitter and the protection cover are located below the highest point of an upper surface of the straddle seat in side view.

8. The personal watercraft according to claim 1, further comprising a base located between the light emitter and the watercraft body and connecting the light emitter and the protection cover to the watercraft body, wherein the light emitter, the protection cover, and the base are integrated into a light unit.

9. The personal watercraft according to claim 1, further comprising a base located between the light emitter and the watercraft body and connecting the light emitter and the protection cover to the deck, wherein the deck comprises a mounting wall on which the base is mounted, and the base is secured to the mounting wall, with a surface of the base in contact with a surface of the mounting wall.

10. The personal watercraft according to claim 9, wherein the mounting wall is provided with a through hole, and the personal watercraft further comprises:

a projecting portion projecting from the base toward an inside of the watercraft body and inserted through the through hole;

a light-side connector provided in the projecting portion and electrically connected to the light emitter;

a watercraft body-side connector located between the hull and the deck in the up-down direction and connected to the light-side connector; and an electric power supply located between the hull and the deck in the up-down direction, the electric power supply being electrically connected to the watercraft body-side connector to supply electric power to the light emitter through the watercraft body-side connector and the light-side connector.

11. The personal watercraft according to claim 5, wherein each of the upper and lower flow-regulating walls has an edge facing toward an inside of the watercraft body, and a gap is provided between the edge of each of the upper and lower flow-regulating walls and the protection cover.

12. The personal watercraft according to claim 1, wherein the flow-regulating structure further comprises a right flow-regulating wall and a left flow-regulating wall that are opposed to each other in a right-left direction, the right and left flow-regulating walls being located between the fluid inlet and the protection cover to regulate flow of the fluid entering the watercraft body through the fluid inlet and moving toward the protection cover.

13. A personal watercraft comprising:

a watercraft body comprising a hull and a deck covering an upper portion of the hull;

a light emitter supported by the watercraft body; and a protection cover covering the light emitter and permeable to light emitted by the light emitter, wherein the watercraft body comprises a flow-regulating structure, and the flow-regulating structure comprises:

a fluid inlet through which an external fluid enters the watercraft body; and a right flow-regulating wall and a left flow-regulating wall that are opposed to each other in a right-left direction, the right and left flow-regulating walls being located between the fluid inlet and the protection cover to regulate flow of the fluid entering the watercraft body through the fluid inlet and moving toward the protection cover.

* * * * *